US011397058B2

(12) United States Patent
Park et al.

(10) Patent No.: US 11,397,058 B2
(45) Date of Patent: Jul. 26, 2022

(54) HEAT TRANSFER FIN OF FIN-TUBE TYPE HEAT EXCHANGER

(71) Applicant: KYUNGDONG NAVIEN CO., LTD., Gyeonggi-do (KR)

(72) Inventors: Jun Gil Park, Seoul (KR); In Chul Jeong, Seoul (KR); Jung Yul Bae, Seoul (KR)

(73) Assignee: KYUNGDONG NAVIEN CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/387,113

(22) Filed: Apr. 17, 2019

(65) Prior Publication Data

US 2019/0323784 A1 Oct. 24, 2019

(30) Foreign Application Priority Data

Apr. 19, 2018 (KR) ..... 10-2018-0045350
Mar. 27, 2019 (KR) ..... 10-2019-0035134

(51) Int. Cl.
*F28F 1/32* (2006.01)

(52) U.S. Cl.
CPC ..... *F28F 1/325* (2013.01); *F28F 2215/08* (2013.01); *F28F 2215/10* (2013.01)

(58) Field of Classification Search
CPC ..... F28D 1/0478; F28D 1/0477; F28F 1/325
USPC ..... 165/181
See application file for complete search history.

(56) References Cited

U.S. PATENT DOCUMENTS 821,698 A * 5/1906 Briscoe ..... F28F 1/12 165/181
858,258 A * 6/1907 Briscoe et al. ..... B23K 33/008 228/171
1,045,267 A * 11/1912 Dippert ..... F28F 1/325 165/151
1,350,833 A * 8/1920 Murray ..... B21C 37/24 165/181
1,398,612 A * 11/1921 Victor ..... F16J 15/122 277/592
1,557,775 A * 10/1925 Robertson ..... F16J 15/128 277/598
1,730,470 A * 10/1929 Modine ..... B23K 1/08 228/171
1,840,651 A * 1/1932 Bassler ..... F28F 1/24 165/181

(Continued)

FOREIGN PATENT DOCUMENTS

WO WO 2013/161802 A1 * 10/2013

*Primary Examiner* — Ljiljana V. Ciric
(74) *Attorney, Agent, or Firm* — Wegman Hessler

(57) ABSTRACT

A heat transfer fin includes a fin body and a plurality of through-holes formed through the fin body and spaced apart from each other in a first direction. When a flow direction of combustion gas that is to flow along a surface of the fin body is referred to as a second direction, the fin body includes a distal surrounding part that surrounds a first distal area located at the farthest upstream side of each of the through-holes. The shortest distance between an inner and an outer boundary of the distal surrounding part that is obtained in an area of the distal surrounding part located at the farthest upstream side is smaller than the shortest distance between the inner and the outer boundary that is obtained in an area of the distal surrounding part located at the farthest downstream side.

19 Claims, 14 Drawing Sheets

(56) References Cited

U.S. PATENT DOCUMENTS 1,864,328 A * 6/1932 Victor ..... F16J 15/123 277/591
1,913,175 A * 6/1933 Summers ..... F25B 39/04 29/890.035
1,949,041 A * 2/1934 De Lagabbe ..... F01N 3/05 181/239
1,966,785 A * 7/1934 Boucher, Jr. ..... F02F 1/065 123/41.69
2,011,900 A * 8/1935 Laird ..... F28D 1/0535 165/172
2,134,868 A * 11/1938 Fitzgerald ..... F16J 15/0818 277/599
2,170,774 A * 8/1939 Fagan ..... B21D 53/085 29/890.046
2,191,050 A * 2/1940 Trice ..... F02F 1/04 123/41.56
2,204,332 A * 6/1940 Trent ..... F28F 1/24 165/181
2,220,944 A * 11/1940 Murray, Jr. ..... F22B 37/102 165/181
2,243,402 A * 5/1941 Trainer ..... F23M 5/08 428/602
2,330,065 A * 9/1943 Lucke ..... F02F 1/065 165/181
2,427,200 A * 9/1947 Dreier ..... F25D 21/14 62/288
2,534,690 A * 12/1950 Young, Jr. ..... F16L 3/227 248/68.1
2,540,339 A * 2/1951 Kritzer ..... F28F 1/325 165/151
2,558,952 A * 7/1951 Hayward ..... B21D 53/085 29/890.047
2,574,142 A * 11/1951 Buongirno ..... F28F 1/30 165/181
2,602,650 A * 7/1952 Marcotte ..... F28D 1/053 165/134.1
2,624,555 A * 1/1953 Di Vincenzo ..... B21C 37/24 165/181
2,699,923 A * 1/1955 Walworth ..... F28F 9/262 165/181
2,716,802 A * 9/1955 Greer, Jr. ..... B21D 53/08 165/181
2,804,286 A * 8/1957 Pintarelli ..... F28D 1/053 165/182
2,858,115 A * 10/1958 Stebbins ..... F28F 1/30 165/181
2,874,555 A * 2/1959 Disinger ..... F25B 39/02 62/525
2,976,022 A * 3/1961 Gannon ..... F28D 1/053 165/182
2,977,918 A * 4/1961 Kritzer ..... B21C 37/24 165/181
3,135,320 A * 6/1964 Forgo ..... F28F 1/325 165/181
3,149,667 A * 9/1964 Astrup ..... F28F 1/32 165/134.1
3,153,443 A * 10/1964 Kritzer ..... F28D 1/0477 165/181
3,182,481 A * 5/1965 Kinal ..... B21D 53/085 72/326
3,189,087 A * 6/1965 Parris ..... F28F 1/30 165/181
3,191,670 A * 6/1965 Jones ..... F28F 9/013 165/181
3,216,095 A * 11/1965 Kurtz ..... B21C 37/24 228/183
3,217,798 A * 11/1965 Renzi ..... F28F 1/12 165/181
3,222,764 A * 12/1965 Hansson ..... B21C 37/151 165/172
3,223,153 A * 12/1965 Simpelaar ..... F28F 1/325 29/890.047
3,251,410 A * 5/1966 Raskin ..... F28F 1/36 165/181
3,266,567 A * 8/1966 Kinal ..... F28F 1/325 165/182
3,397,741 A * 8/1968 Gunter ..... F28F 1/325 165/181
3,407,874 A * 10/1968 Gier, Jr. ..... F28F 1/126 165/151
3,431,973 A * 3/1969 Kritzer ..... B21C 37/225 165/172
3,437,297 A * 4/1969 Jirka ..... F16L 3/2235 248/68.1
3,457,988 A * 7/1969 Stewart ..... H01L 23/3672 257/688
3,473,813 A * 10/1969 Bailey ..... F16J 15/123 277/601
3,490,524 A * 1/1970 Pasternak ..... F28F 1/30 165/181
3,503,441 A * 3/1970 Sarnezki ..... H01J 23/033 165/181
3,687,194 A * 8/1972 Scholl ..... F28F 1/32 165/181
3,739,147 A * 6/1973 Mayhew ..... H05B 3/58 219/535
3,759,050 A * 9/1973 Slaasted ..... F25B 39/02 165/181
3,771,595 A * 11/1973 Slaasted ..... F28F 1/02 165/151
3,780,797 A * 12/1973 Gebelius ..... F28D 1/053 165/181
3,780,799 A * 12/1973 Pasternak ..... F28D 1/0477 165/150
3,841,289 A * 10/1974 Meyers ..... F02F 11/002 123/193.3
3,916,989 A * 11/1975 Harada ..... F28F 1/325 165/181
4,041,727 A * 8/1977 Maudlin ..... F25D 21/14 165/181
4,098,326 A * 7/1978 Waters ..... F28D 15/0275 138/112
4,141,411 A * 2/1979 Kalnin ..... F25B 39/04 165/181
4,184,862 A * 1/1980 Waters ..... F28D 15/0275 248/68.1
4,269,267 A * 5/1981 Labrande ..... B21C 37/22 165/181
4,279,298 A * 7/1981 Lee ..... F28F 17/005 165/181
4,298,062 A * 11/1981 Pasternak ..... F28F 1/26 165/181
4,300,273 A * 11/1981 Lockhart ..... B23P 15/00 156/264
4,300,630 A * 11/1981 Trojani ..... F28F 1/124 165/181
4,365,667 A * 12/1982 Hatada ..... F28F 1/325 165/181
4,451,051 A * 5/1984 Nicholson ..... F16J 15/0825 277/595
4,492,851 A * 1/1985 Carr ..... F25D 21/08 165/181
4,562,703 A * 1/1986 Miller ..... F17C 3/085 165/181
4,648,443 A * 3/1987 Szucs ..... F28F 1/30 165/181
4,653,761 A * 3/1987 Baugh ..... F02B 75/20 277/599
4,696,262 A * 9/1987 Roggendorff ..... F01P 1/02 123/41.69
4,714,260 A * 12/1987 Udagawa ..... F16J 15/0825 277/599
4,723,599 A * 2/1988 Hanson ..... F28F 1/325 165/181
4,750,749 A * 6/1988 Nicholson ..... F16J 15/0825 277/595
4,771,825 A * 9/1988 Chen ..... F28F 1/30 165/151

(56) References Cited

U.S. PATENT DOCUMENTS 4,789,027 A * 12/1988 Diethelm ..... F28F 1/32 165/181
4,791,984 A * 12/1988 Hatada ..... F28F 1/32 165/151
4,799,540 A * 1/1989 Pietzcker ..... B21D 53/085 165/181
4,807,892 A * 2/1989 Udagawa ..... F16J 15/0825 277/592
4,830,102 A * 5/1989 Bakay ..... F28F 1/325 165/151
4,834,399 A * 5/1989 Udagawa ..... F16J 15/0825 277/592
4,928,756 A * 5/1990 Shull ..... F28F 1/30 165/53
4,968,045 A * 11/1990 Abe ..... F16J 15/0825 277/592
4,979,758 A * 12/1990 Miyaoh ..... F16J 15/0825 277/595
4,984,626 A * 1/1991 Esformes ..... F28F 1/325 165/181
5,029,782 A * 7/1991 Andre ..... F16L 3/2235 248/68.1
5,046,556 A * 9/1991 Andersson ..... F28F 1/30 165/181
5,056,586 A * 10/1991 Bemisderfer ..... F28F 1/128 165/181
5,058,665 A * 10/1991 Harada ..... F28F 3/086 165/DIG. 360
5,109,919 A * 5/1992 Sakuma ..... F28F 1/325 165/181
5,111,876 A * 5/1992 Nash ..... F28F 17/005 165/181
5,168,923 A * 12/1992 Sacks ..... F28F 1/325 29/890.047
5,261,355 A * 11/1993 Scalfi ..... F28F 3/04 122/225 A
5,269,541 A * 12/1993 Inamura ..... F02F 11/002 277/595
5,303,943 A * 4/1994 Batty, Jr. ..... F16J 15/128 277/313
5,467,816 A * 11/1995 Larinoff ..... F28F 1/02 165/151
5,501,270 A * 3/1996 Young ..... F28F 1/325 165/182
5,516,063 A * 5/1996 Buckshaw ..... F16L 3/2235 211/60.1
5,582,244 A * 12/1996 Helms ..... F28F 1/325 165/182
5,584,340 A * 12/1996 Derosier ..... F28F 9/0131 165/149
5,584,490 A * 12/1996 Inoue ..... F16J 15/0825 277/595
5,611,395 A * 3/1997 Kang ..... F28F 1/325 165/182
5,615,850 A * 4/1997 Cloninger ..... F16L 3/22 248/68.1
5,660,230 A * 8/1997 Obosu ..... F28F 1/325 165/182
5,692,561 A * 12/1997 Kang ..... F28F 1/325 165/181
5,704,417 A * 1/1998 Christensen ..... F28F 3/027 165/110
5,704,420 A * 1/1998 Kim ..... F28F 1/325 165/181
5,738,168 A * 4/1998 Patel ..... F28F 1/325 165/181
5,755,281 A * 5/1998 Kang ..... F28F 1/325 165/181
D398,313 S * 9/1998 Allen ..... D13/118
5,806,857 A * 9/1998 Mockenhaupt ..... F16J 15/0831 277/317
5,853,175 A * 12/1998 Udagawa ..... F16J 15/0825 277/595
5,854,739 A * 12/1998 Steiner ..... F21V 29/74 361/703
5,947,194 A * 9/1999 Baek ..... F24F 1/0067 165/181
5,975,199 A * 11/1999 Park ..... F28F 17/005 165/181
5,975,200 A * 11/1999 Kato ..... F28F 1/325 165/181
6,026,893 A * 2/2000 Jung ..... F28D 1/0477 165/181
6,168,166 B1 * 1/2001 Akimoto ..... F16J 15/0825 277/594
6,242,712 B1 * 6/2001 Prust ..... F02M 31/13 123/549
6,263,955 B1 * 7/2001 Azar ..... F28F 3/02 174/16.3
6,349,761 B1 * 2/2002 Liu ..... F28F 13/12 165/181
6,382,307 B1 * 5/2002 Wang ..... B23K 1/0012 165/104.33
6,435,266 B1 * 8/2002 Wu ..... F28F 1/24 29/890.032
6,457,724 B2 * 10/2002 Ogaeri ..... F16J 15/0825 277/591
6,478,079 B1 * 11/2002 Kato ..... F28F 1/32 165/151
6,640,888 B1 * 11/2003 Horng ..... F28F 1/24 257/722
6,644,389 B1 * 11/2003 Kang ..... F28F 1/325 165/146
6,651,733 B1 * 11/2003 Horng ..... F28D 15/02 165/104.33
6,651,989 B2 * 11/2003 Johnson ..... F16J 15/0825 277/598
6,675,884 B1 * 1/2004 Shen ..... F28F 1/32 165/181
6,741,468 B2 * 5/2004 Jing ..... F28D 15/0275 165/181
6,772,830 B1 * 8/2004 Larsen ..... F28F 13/06 165/172
6,802,362 B2 * 10/2004 Wenger ..... F28F 1/24 165/181
6,955,214 B2 * 10/2005 Wang ..... F28D 1/0477 165/104.21
6,973,960 B1 * 12/2005 Seidel ..... F28F 3/083 165/67
7,004,242 B2 * 2/2006 Gong ..... F28F 1/32 165/172
7,021,591 B1 * 4/2006 Gretz ..... F16L 3/223 248/68.1
7,063,131 B2 * 6/2006 Northrop ..... F28F 1/24 165/133
7,082,989 B2 * 8/2006 Kobayashi ..... F28D 1/0477 165/181
7,120,026 B2 * 10/2006 Chen ..... H01L 23/3672 361/704
7,121,333 B2 * 10/2006 Wang ..... F28F 1/32 165/182
D541,758 S * 5/2007 Lee ..... D13/179
D567,771 S * 4/2008 Wu ..... D13/179
7,409,983 B2 * 8/2008 Lin ..... H01L 23/3672 257/E23.103
7,426,956 B2 * 9/2008 Lin ..... H01L 23/427 165/104.33
7,575,045 B2 * 8/2009 Sheng ..... F28D 15/0275 165/104.21
7,660,123 B1 * 2/2010 Lin ..... H01L 21/4882 174/16.3
8,453,716 B2 * 6/2013 Hsieh ..... F28D 15/0275 165/104.33
D685,745 S * 7/2013 Lee ..... D13/155
8,505,618 B2 * 8/2013 Ogawa ..... F28F 1/325 165/181

(56) References Cited

U.S. PATENT DOCUMENTS 8,800,639 B2 * 8/2014 Chen ..... F28D 15/0275 165/104.21
9,683,735 B2 * 6/2017 Bowyer ..... F16L 3/223
9,982,948 B2 * 5/2018 Lee ..... F28F 1/32
10,139,002 B1 * 11/2018 Yasuda ..... C21D 8/0205
10,184,424 B2 * 1/2019 Morimoto ..... F02F 1/24
10,254,053 B2 * 4/2019 Okamoto ..... F28F 1/32
10,295,281 B2 * 5/2019 Kasamatsu ..... F28D 1/0477
10,794,640 B2 * 10/2020 Kondo ..... F28D 1/0472
11,079,180 B2 * 8/2021 Tomohiko ..... F28D 1/024
11,243,033 B2 * 2/2022 Iguchi ..... F24H 1/107
2002/0003035 A1 * 1/2002 Oh ..... F28F 1/325 165/181
2002/0117295 A1 * 8/2002 Shen ..... F28F 1/30 165/181
2004/0050539 A1 * 3/2004 Bemisderfer ..... F28F 1/325 165/181
2005/0016718 A1 * 1/2005 Papapanu ..... F28F 1/325 165/181
2006/0070721 A1 * 4/2006 Chen ..... F28F 3/02 165/80.3
2009/0133863 A1 * 5/2009 Ogawa ..... F28F 1/325 165/185
2009/0218082 A1 * 9/2009 Shen ..... F28D 15/0266 165/181
2009/0308585 A1 * 12/2009 Chen ..... F28F 1/325 165/185
2010/0000726 A1 * 1/2010 Lee ..... F28F 13/08 165/181
2010/0038064 A1 * 2/2010 Liu ..... F28F 1/32 165/181
2010/0089562 A1 * 4/2010 Shibata ..... F24F 1/0067 165/181
2010/0107681 A1 * 5/2010 Morimoto ..... F24F 1/027 165/181
2010/0205993 A1 * 8/2010 Matsuda ..... F24F 1/0047 165/181
2010/0218533 A1 * 9/2010 Lee ..... F25B 39/00 165/181
2010/0252247 A1 * 10/2010 Smith, III ..... F28F 13/18 165/181
2010/0307180 A1 * 12/2010 Yamada ..... F28D 20/02 165/185
2010/0326643 A1 * 12/2010 Hancock ..... F28D 1/0477 165/181
2011/0036551 A1 * 2/2011 Hancock ..... F28F 1/325 165/181
2011/0048681 A1 * 3/2011 Chen ..... H01L 23/427 165/104.26
2011/0094258 A1 * 4/2011 Lee ..... F28F 1/40 62/498
2011/0168373 A1 * 7/2011 Kim ..... F28F 1/28 165/181
2011/0308228 A1 * 12/2011 Freund ..... F28D 7/16 165/181
2012/0103583 A1 * 5/2012 Kim ..... F28D 1/05391 165/173
2012/0175101 A1 * 7/2012 Tamura ..... F28F 1/325 165/181
2013/0186608 A1 * 7/2013 Liu ..... F28D 15/0233 165/181
2014/0020880 A1 * 1/2014 Fanberg ..... F28F 1/30 165/185
2014/0190425 A1 * 7/2014 Oohigashi ..... F24H 1/43 122/18.4
2014/0223956 A1 * 8/2014 Lee ..... F28F 1/32 165/181
2014/0367076 A1 * 12/2014 Uto ..... B60H 1/00321 165/181
2015/0068718 A1 * 3/2015 Ota ..... F28F 3/027 165/181
2015/0075760 A1 * 3/2015 Huang ..... C22C 1/00 165/181
2015/0211807 A1 * 7/2015 Groskreutz ..... F28F 1/32 165/172
2015/0354508 A1 * 12/2015 Kobayashi ..... F28F 1/40 165/181
2016/0025426 A1 * 1/2016 Strange ..... F28F 3/022 165/181
2016/0076815 A1 * 3/2016 Chen ..... F28D 1/0477 165/181
2016/0153725 A1 * 6/2016 Cheng ..... F28D 15/0233 165/185
2016/0273850 A1 * 9/2016 Okamoto ..... F28F 1/32
2020/0318911 A1 * 10/2020 Shabtay ..... F28F 1/325
2020/0370841 A1 * 11/2020 Muley ..... F28F 21/06
2021/0108865 A1 * 4/2021 Akagi ..... F28F 1/32
2021/0156623 A1 * 5/2021 Iguchi ..... F28F 1/325
2021/0156629 A1 * 5/2021 Wada ..... F24H 1/107
2021/0239410 A1 * 8/2021 Mahajan ..... F28F 3/027
2021/0270542 A1 * 9/2021 Schlieper ..... F28F 1/325
2021/0325127 A1 * 10/2021 Feng ..... F28F 1/325
2022/0011048 A1 * 1/2022 Jung ..... F28F 21/084

* cited by examiner

HEAT TRANSFER FIN OF FIN-TUBE TYPE HEAT EXCHANGER

CROSS-REFERENCE TO RELATED APPLICATION

This application claims the benefit of priority to Korean Patent Application No. 10-2018-0045350, filed in the Korean Intellectual Property Office on Apr. 19, 2018, and Korean Patent Application No. 10-2019-0035134, filed in the Korean Intellectual Property Office on Mar. 27, 2019, the entire contents of which are incorporated by reference herein.

TECHNICAL FIELD

The present disclosure relates to a heat transfer fin used in a fin-tube type heat exchanger.

BACKGROUND

In general, a burner that includes a heat source for radiating heat and a heat exchanger that transfers radiant heat emitted from the heat source and convection heat of combustion gas generated by the burner to a heating medium to heat heating water are disposed in an electric heating apparatus such as a boiler, a water heater, or a hot-water mat.

The heat exchanger has a tube disposed therein. The heating medium flows through the tube, and the combustion gas flows outside the tube. Therefore, heat exchange between the heating medium and the combustion gas is indirectly performed through the tube.

A plurality of fins may be mounted on the tube to facilitate the heat exchange through the tube. The heat exchanger of this type is referred to as a fin-tube type heat exchanger. Because the fins having a plate shape are mounted on the tube, the surface area of the tube that makes contact with the combustion gas may be increased, and a larger amount of heat may be transferred from the combustion gas to the heating medium.

However, in the fin-tube type heat exchanger, heat is excessively concentrated on a partial area of the tube so that calcium ions of heating water mainly used as the heating medium flowing through the tube are precipitated as oxide to form lime. The lime blocks the flow of the heating water. Hence, the amount of heat transferred by the combustion gas is reduced, and the flow rate of the heating water flowing through the tube is also decreased.

SUMMARY

The present disclosure has been made to solve the above-mentioned problems occurring in the prior art while advantages achieved by the prior art are maintained intact.

An aspect of the present disclosure provides a heat transfer fin having excellent temperature distribution characteristics that is used in a fin-tube type heat exchanger.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a heat transfer fin includes a fin body having a plate shape and a plurality of through-holes formed through the fin body and spaced apart from each other in a first direction. When a flow direction of combustion gas that is to flow along a surface of the fin body is referred to as a second direction, the fin body includes a distal surrounding part that surrounds a first distal area located at the farthest upstream side of each of the through-holes with respect to the second direction. The shortest distance between an inner boundary and an outer boundary of the distal surrounding part that is obtained in an area of the distal surrounding part that is located at the farthest upstream side with respect to the second direction is smaller than the shortest distance between the inner boundary and the outer boundary that is obtained in an area of the distal surrounding part that is located at the farthest downstream side with respect to the second direction.

According to another aspect of the present disclosure, a heat transfer fin includes a fin body having a plate shape and a plurality of through-holes formed through the fin body and spaced apart from each other in a first direction, in which a tube through which a heating medium flows is inserted through each of the through-holes. When a flow direction of combustion gas that is to flow along the fin body is referred to as a second direction, the fin body includes a distal surrounding part that surrounds a first distal area located at the farthest upstream side of the through-hole with respect to the second direction and middle surrounding parts that extend from the distal surrounding part in the second direction and that surround a middle area of the through-hole that is located downstream of the first distal area with respect to the second direction. The distal surrounding part has a smaller width than the middle surrounding parts.

According to another aspect of the present disclosure, a heat transfer fin includes a fin body having a plate shape and a plurality of through-holes formed through the fin body and spaced apart from each other in a first direction, in which a tube through which a heating medium flows is inserted through each of the through-holes. When a flow direction of combustion gas that is to flow along the fin body is referred to as a second direction, the fin body includes a distal surrounding part that surrounds a first distal area located at the farthest upstream side of the through-hole with respect to the second direction. When a reference curve refers to a virtual curve that has a curvilinear shape corresponding to an inner boundary of the distal surrounding part by which the distal surrounding part and the first distal area are divided from each other, maintains a predetermined distance from the inner boundary on the same plane, and passes through intersections of an outer boundary of the distal surrounding part by which the distal surrounding part and the outside of the fin body are divided from each other and a reference straight line that is a virtual straight line drawn parallel to the first direction, at least part of the outer boundary located to correspond to the reference curve is located inward of the reference curve, in at least one of the plurality of distal surrounding parts that surround the first distal areas of the plurality of through-holes, respectively.

According to another aspect of the present disclosure, a heat transfer fin includes a fin body having a plate shape and a plurality of through-holes formed through the fin body and spaced apart from each other in a first direction, in which a tube through which a heating medium flows is inserted through each of the through-holes. When a flow direction of combustion gas that is to flow along the fin body is referred to as a second direction, the fin body includes a distal surrounding part that surrounds a first distal area located at the farthest upstream side of the through-hole with respect to the second direction. When a reference curve refers to a virtual curve that has a curvilinear shape corresponding to an outer boundary of the distal surrounding part by which the distal surrounding part and the outside of the fin body are divided from each other, maintains a predetermined distance from the outer boundary on the same plane, and passes through intersections of an inner boundary of the distal surrounding part by which the distal surrounding part and the first distal area are divided from each other and a reference straight line that is a virtual straight line drawn parallel to the first direction, at least part of the inner boundary located to correspond to the reference curve is located outward of the reference curve, in at least one of the plurality of distal surrounding parts that surround the first distal areas of the plurality of through-holes, respectively.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
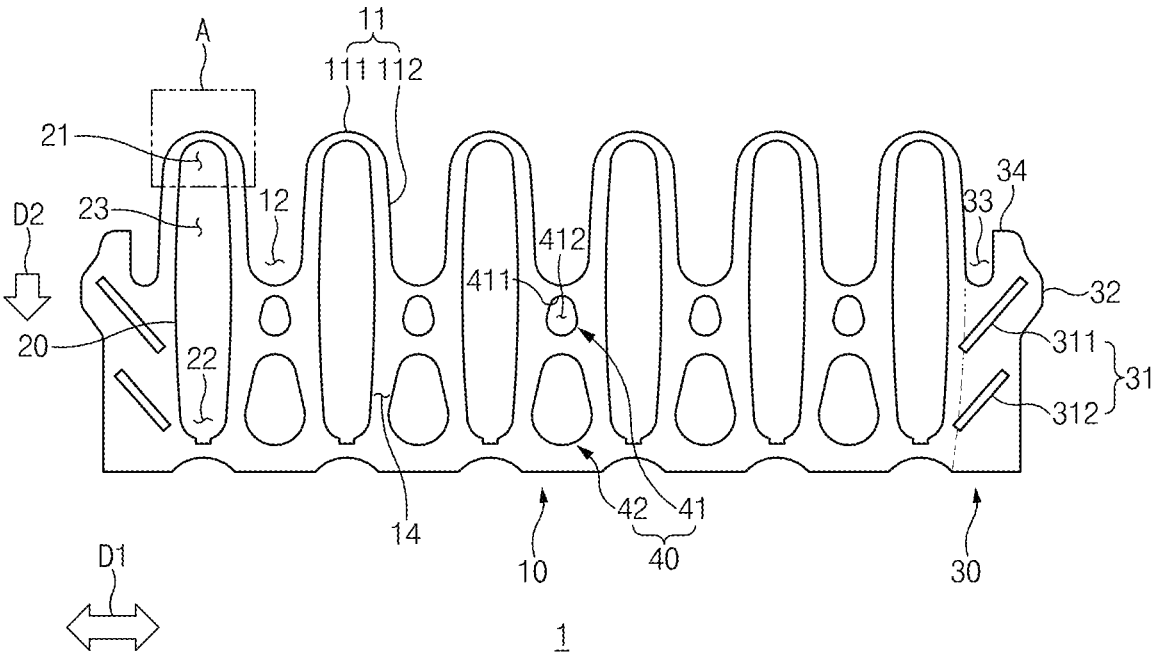
FIG. 1 is a front view illustrating a heat transfer fin according to a first embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the components. When a component is described as "connected", "coupled", or "linked" to another component, they may mean the components are not only directly "connected", "coupled", or "linked" but also are indirectly "connected", "coupled", or "linked" via a third component.

FIG. 1 is a front view illustrating a heat transfer fin 1 according to a first embodiment of the present disclosure.

Referring to FIG. 1, the heat transfer fin 1 according to the first embodiment of the present disclosure includes a fin body 10 and through-holes 20 formed through the fin body 10. The fin body 10 includes a distal surrounding part 111 that surrounds a partial area of each of the through-holes 20. The horizontal direction indicated by a double arrow in FIG. 1 is a first direction D1 in which the through-holes 20 are spaced apart from each other. The vertical direction indicated by a single arrow in FIG. 1 is a second direction D2 in which combustion gas is to flow in a heat exchanger in which the heat transfer fin 1 is used. Tubes (not illustrated) that are combined with the heat transfer fin 1 may extend along one direction that is perpendicular to the first direction D1 and the second direction D2. A plurality of heat transfer fins 1 may be spaced apart from each other along the direction in which a tube extends, and may be combined with the tube.

Fin Body 10

The fin body 10 is a plate-shaped component that transfers heat to the tubes. The fin body 10 may be formed in a plate shape that is perpendicular to a reference direction in which the tubes extend, such that the fin body may have a plate shape with a planar surface. The plurality of through-holes 20 are formed through the fin body 10 and spaced apart from each other along the first direction D1, and through-sections 12 are cut into the fin body 10 along the second direction D2 from an end portion located at the upstream side of the fin body 10.

The fin body 10 may be formed of a metallic material that has a high thermal conductivity and can be shaped into various shapes. The tubes are inserted through the through-holes 20, which are formed through the fin body 10, and combined with the fin body 10. Heat transferred to the fin body 10 may be transferred to the tubes. To connect the fin body 10 and the tubes without a separate coupler, the through-holes 20 may have a slightly smaller area than the tubes, and the tubes may be press fitted into the through-holes 20. Alternatively, both the tubes and the fin body 10 may be formed of metal and may be combined with each other by welding. However, a method of combining the tubes and the fin body 10 together is not limited thereto.

The fin body 10 has the through-holes 20 and the through-sections 12 formed therein. The plurality of through-holes 20 and through-sections 12 may be formed in the fin body 10. Accordingly, the fin body 10 may have intervening sections 14, each of which is located between the through-holes 20 adjacent to each other and downstream of a corresponding one of the through-sections 12 with respect to the second direction D2. Flanges 40, which will be described below, may be formed in the intervening sections 14, respectively. Furthermore, partial areas of the fin body 10 may be surrounding parts 11 that will be described below.

Through-Holes 20

The through-holes 20 are formed through the fin body 10 such that the tubes through which a heating medium flows are inserted through the through-holes 20. The tubes are inserted through the through-holes 20, and therefore the through-holes 20 are formed as openings that are open in the reference direction which the tubes extend. The reference direction is a direction into or out of the plane of the drawing.

The through-holes 20 may be of a circular type formed in a circular shape or an oval type formed in an elliptical shape. In this case, circular tubes having a circular cross-section, or oval tubes having an elliptical cross-section, may be inserted through the through-holes 20.

However, the through-holes 20 may be formed in the shape of a long narrow hole that extends along the second direction D2. As each of the through-holes 20 is formed in the shape of a long narrow hole, the through-hole 20 has opposite distal areas 21 and 22 and a middle area 23 located between the opposite distal areas 21 and 22. A plurality of curves, such as arcs or parabolas, may be continuously combined with each other to form the profile of the through-hole 20 in the fin body 10. Furthermore, a flat tube, the cross-section of which extends in one direction, may be inserted through the through-hole 20.

Each of the tubes has a heat transfer area to receive heat through contact with the combustion gas. Assuming that a flat tube, a circular tube, and an oval tube have the same cross-sectional area, the heat transfer area of the flat tube may be larger than the heat transfer area of the circular tube or the oval tube, and therefore the thermal efficiency of the flat tube may higher than the thermal efficiency of the circular tube or the oval tube.

The time that heating water flowing through the flat tube starts to boil may be similar to the time that heating water flowing through the circular tube or the oval tube starts to boil. However, due to the shapes of the cross-sections, lime is more likely to be generated in the flat tube than in the circular tube or the oval tube. The area that meets the combustion gas first, among distal ends of the flat tube that are identifiable in the direction in which the cross-section of the flat tube extends, may be overheated. Therefore, heating water may be more likely to start to boil, and lime may be more likely to be generated.

The first distal area 21 and the second distal area 22 of the through-hole 20 are formed farthest upstream and downstream of the middle area 23 of the through-hole 20, respectively, with respect to the second direction D2. Accordingly, the middle area 23 is an adjacent area located downstream of the first distal area 21 and upstream of the second distal area 22.

In the case where the through-hole 20 is constituted by a plurality of arcs, the middle area 23 may be implemented with two arcs that have line symmetry with respect to the center line parallel to the second direction D2, the first distal area 21 and the second distal area 22 may be implemented with two arcs that have line symmetry with respect to the center line parallel to the first direction D1, and the listed arcs may be continuously combined with each other to form the through-hole 20. In this case, the radius of curvature of the profile of the first distal area 21 may be smaller than the radii of curvature of the arcs constituting the middle area 23. Accordingly, a curvature variation occurs at an inner contact point (reference numeral 114 of FIG. 2) where two different arcs meet each other.

The plurality of through-holes 20 may be spaced apart from each other along the direction that is perpendicular to the second direction D2 and the reference direction. The direction is the first direction D1. The through-holes 20 may be spaced at predetermined intervals from each other along the first direction D1. Although FIG. 1 illustrates one example that the fin body 10 includes a total of six through-holes 20, the number of through-holes 20 is not limited thereto.

Surrounding Parts 11

Figure 2:
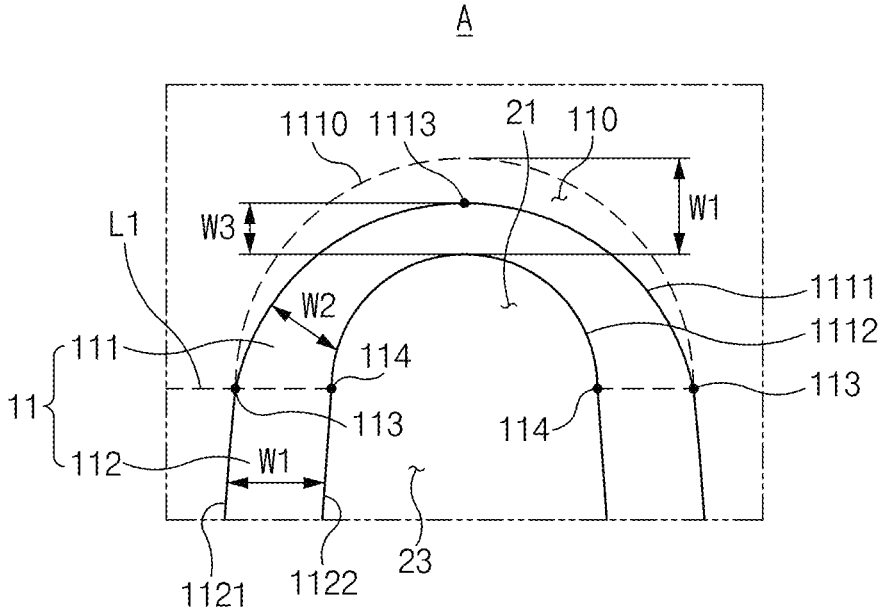
FIG. 2 is a blowup of region A in FIG. 1.

FIG. 2 is an enlarged front view illustrating region A of the heat transfer fin 1 according to the first embodiment of the present disclosure.

Referring to FIGS. 1 and 2, the fin body 10 included in the heat transfer fin 1 according to the first embodiment of the present disclosure includes the surrounding parts 11. Each of the surrounding parts 11 includes middle surrounding parts 112 and the distal surrounding part 111.

At least opposite sides of the middle area 23 of each through-hole 20 that are oriented in the first direction D1 are surrounded by the middle surrounding parts 112, and the periphery of the first distal area 21 of the through-hole 20 is surrounded by the distal surrounding part 111. The middle surrounding parts 112 extend from the distal surrounding part 111 in the second direction D2. Accordingly, the surrounding part 11 surrounds at least a partial area of the through-hole 20.

The plurality of surrounding parts 11 may be disposed around the plurality of through-holes 20, respectively, and may have different shapes.

The middle surrounding parts 112 of each surrounding part 11 are partial areas of the fin body 10 that surround the middle area 23 of the corresponding through-hole 20. The middle surrounding parts 112 protrude outward from the periphery of the middle area 23 of the through-hole 20 by a predetermined width. Accordingly, the profiles of outer boundaries 1121 of the middle surrounding parts 112 are the same as the profile of the middle area 23 of the through-hole 20 and are spaced apart from the middle area 23 by the predetermined width. The width of each middle surrounding part 112 may be defined as the shortest distance from one point on an inner boundary 1122 of the middle surrounding part 112 to the outer boundary 1121 of the middle surrounding part 112. Furthermore, as illustrated in FIG. 2, the width of the middle surrounding part 112 may remain a constant width of W1 for the entirety of the middle surrounding part 112.

The distal surrounding part 111 is a partial area of the fin body 10 that surrounds the first distal area 21 of the through-hole 20. The distal surrounding part 111 protrudes outward from the periphery of the first distal area 21 of the through-hole 20, similarly to the middle surrounding parts 112.

The distal surrounding part 111 may be continuous with the middle surrounding parts 112. Accordingly, two outer contact points 113 and two inner contact points 114, which are connection points, may be formed on the planes where the distal surrounding part 111 and the middle surrounding parts 112 make contact with each other. Because the widths of the middle surrounding parts 112 remain W1, the distances from the outer contact points 113 to the inner contact points 114 may be equal to the widths W1 of the middle surrounding parts 112.

In the case where a circular tube or an oval tube is used in the heat exchanger, a groove may be formed in an area corresponding to a distal surrounding part, or an area of a surrounding part that is located upstream may be cut, to prevent heat from being concentrated on an upstream side of the tube in order to prevent generation of lime and acoustic boiling noise in the tube.

Figure 8:
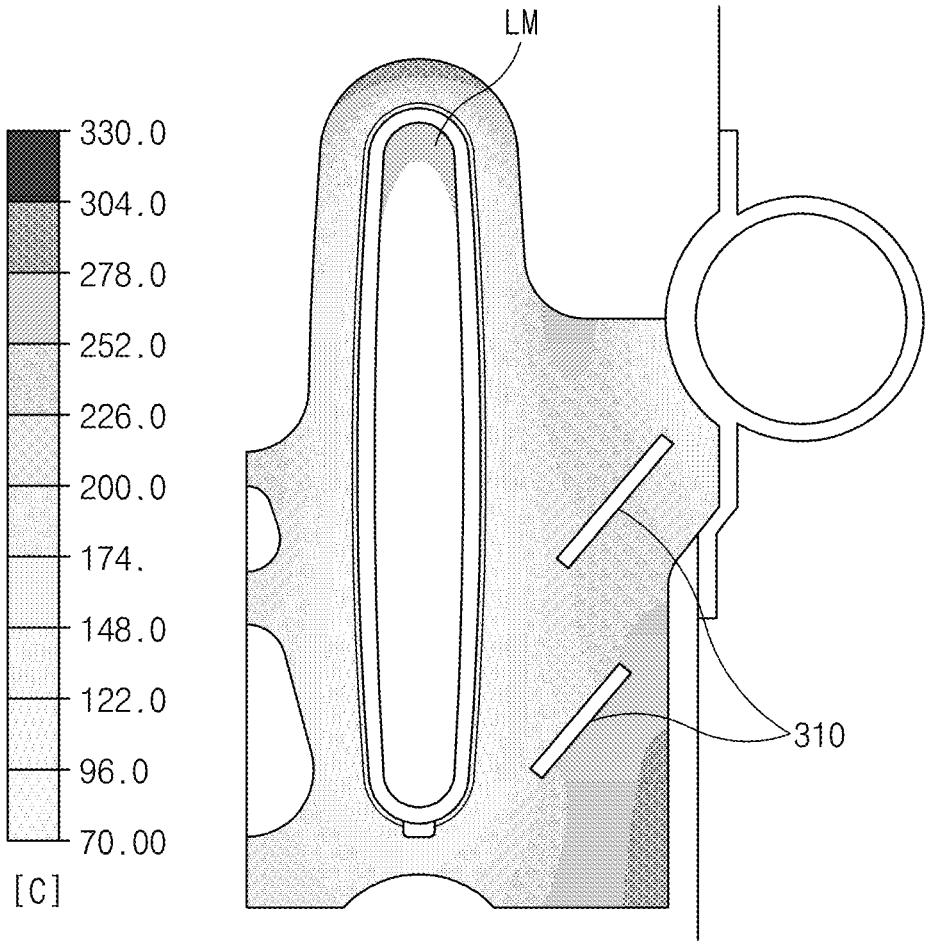
FIG. 8 is a view illustrating the temperature distribution of the existing heat transfer fin.

However, in the case of a flat tube, as illustrated in FIG. 8, the heat exchange area at the upstream side of the flat tube is wide, and therefore it may be difficult to reduce the amount of lime (LM of FIG. 8) formed in the flat tube, by only forming some grooves on a surrounding part disposed around the flat tube or cutting a portion of the farthest upstream side of the surrounding part. That is because the remaining portions of the surrounding part other than the grooves or the cut portion are disposed around the tube as they are and hence heat of combustion gas is still concentrated through the remaining portions and transferred to the tube.

Hence, the distal surrounding part 111 according to an embodiment of the present disclosure may be formed such that the shortest distance W1 between an inner boundary 1112 and an outer boundary 1111 that is obtained at the farthest downstream side of the distal surrounding part 111 with respect to the second direction D2 is greater than the shortest distance W3 between the inner boundary 1112 and the outer boundary 1111 that is obtained in another area of the distal surrounding part 111. As described above, the distal surrounding part 111 is formed in the shape in which the area is entirely reduced. Accordingly, even though a flat tube is used in the heat exchanger, the degree of concentration of heat on the distal surrounding part 111 may be reduced, which makes it possible to prevent the heat transfer fin 1 from being overheated, reduce the amount of lime generated in the tube, and reduce acoustic boiling noise.

The middle area 23 and the first distal area 21 of the through-hole 20 are divided from each other at the inner contact points 114 that are connection points, and therefore the definition of the curve constituting the profile of the through-hole 20 may also be changed. Furthermore, the outer boundary 1111 of the distal surrounding part 111 and the outer boundaries 1121 of the middle surrounding parts 112 meet at the outer contact points 113 that are connection points, and therefore the outer boundary 1111 of the distal surrounding part 111 and the outer boundaries 1121 of the middle surrounding parts 112 may be represented by differently defined curves at the outer contact points 113. Straight lines that connect the inner contact points 114 and the outer contact points 113 may be parallel to the first direction D1.

One through-section 12, which is cut into the fin body 10, is formed between two distal surrounding parts 111 that surround first distal areas 21 of two through-holes 20 that are adjacent to each other along the first direction D1. The through-section 12 is formed through the fin body 10 such that the through-section 12 is open in the opposite direction to the second direction D2 from the inside of the fin body 10. Due to the formation of the through-section 12, the distal surrounding parts 111 and the middle surrounding parts 112 naturally meet the outside of the fin body 10. That is, the through-section 12 is located between the adjacent surrounding parts 11, and the crooked profile of the fin body 10 is formed by the through-section 12 and the surrounding parts 11.

The through-section 12 may have a shape, the width of which increases toward the opposite direction to the second direction D2 from a semicircle protruding along the second direction D2. The shape of the upstream side of the through-section 12 is determined by the shapes of the distal surrounding parts 111.

Each of the distal surrounding parts 111 may be defined as an area formed between the inner boundary 1112 and the outer boundary 1111. The inner boundary 1112 of the distal surrounding part 111 refers to a boundary by which the distal surrounding part 111 and the first distal area 21 of the though-hole 20 are divided from each other, and the outer boundary 1111 of the distal surrounding part 111 refers to a boundary by which the distal surrounding part 111 and the outside of the fin body 10 are divided from each other. The distal surrounding part 111 is an area defined by the inner boundary 1112, the outer boundary 1111, and the boundaries between the middle surrounding parts 112 and the distal surrounding part 111.

Referring to FIG. 2, a reference curve 1110 that is a virtual curve corresponding to an outer boundary of a distal surrounding part 110 of an existing heat transfer fin may be identified. The reference curve 1110 is shown by a dotted line in FIG. 2. The reference curve 1110 has a curvilinear shape corresponding to the inner boundary 1112. The reference curve 1110 passes through specific points while maintaining a predetermined distance from the inner boundary 1112 on the same plane. When the reference curve 1110 maintains the predetermined distance from the inner boundary 1112, this means that the shortest distance from one point on the inner boundary 1112 to the reference curve 1110 remains constant for all points. The specific points are intersections where the outer boundary 1111 and a reference straight line L1 that is a virtual straight line drawn parallel to the first direction D1 cross each other. The same plane refers to a plane including the wide surface of the fin body 10 illustrated in FIG. 1. That is because the inner boundary 1112 is formed to have a curved profile on the plane including the wide surface of the fin body 10 that is parallel to the first direction D1 and the second direction D2.

The reference straight line L1 is drawn to cross the outer boundary 1111 of the distal surrounding part 111 at the outer contact points 113 where the distal surrounding part 111 and the middle surrounding parts 112 are connected. When the shortest distance from any point on the inner boundary 1112 to the reference curve 1110 is defined as the width of the existing distal surrounding part 110, the width of the entire existing distal surrounding part 110 remains constant. The width of the existing distal surrounding part 110 may be equal to the widths W1 of the middle surrounding parts 112.

In at least one distal surrounding part 111 according to an embodiment of the present disclosure, the outer boundary 1111 located to correspond to the reference curve 1110 is located inward of the reference curve 1110. Here, when the outer boundary 1111 is located inward of the reference curve 1110, this means that the outer boundary 1111 is located downstream of the reference curve 1110 along the second direction D2.

The shortest distance W3 from an area 1113 located at the farthest upstream side of the distal surrounding part 111 with respect to the second direction D2 to the first distal area 21 of the through-hole 20 is smaller than the distance W1 between the inner contact point 114 and the outer contact point 113 where the distal surrounding part 111 meets the middle surrounding part 112 on one side. Accordingly, the width of the distal surrounding part 111 does not remain constant and decreases toward the upstream side.

The shortest distance from any point on the inner boundary 1112 of the distal surrounding part 111 to the outer boundary 1111 may be defined as the width of the distal surrounding part 111. As the point moves along the inner boundary 1112 in the opposite direction to the second direction D2, the width of the distal surrounding part 111 may be decreased. Accordingly, the shortest distance W2 from one point on the inner boundary 1112 that is located in the middle position of the distal surrounding part 111 to the outer boundary 1111 is smaller than W1 and greater than W3. In this case, the width W3 of the distal surrounding part 111 in the area located at the farthest upstream side of the distal surrounding part 111 corresponds to the smallest of the widths of the distal surrounding part 111.

Furthermore, the inner boundary 1112 may be formed by connecting points where the inner boundary 1112 is divided into N equal parts (N being a natural number), and the outer boundary 1111 may be formed by connecting points where the outer boundary 1111 is divided into N equal parts. The shortest distance between the nth point (n being a natural number of N or smaller) on the inner boundary 1112 and the nth point on the outer boundary 1111 may be decreased as n approaches (N+1)/2.

In the case where the outer boundary 1111 and the inner boundary 1112 are constituted by arcs, the radius of curvature of the outer boundary 1111 may be larger than the radius of curvature of the inner boundary 1112.

One Modified Example

Figure 3:
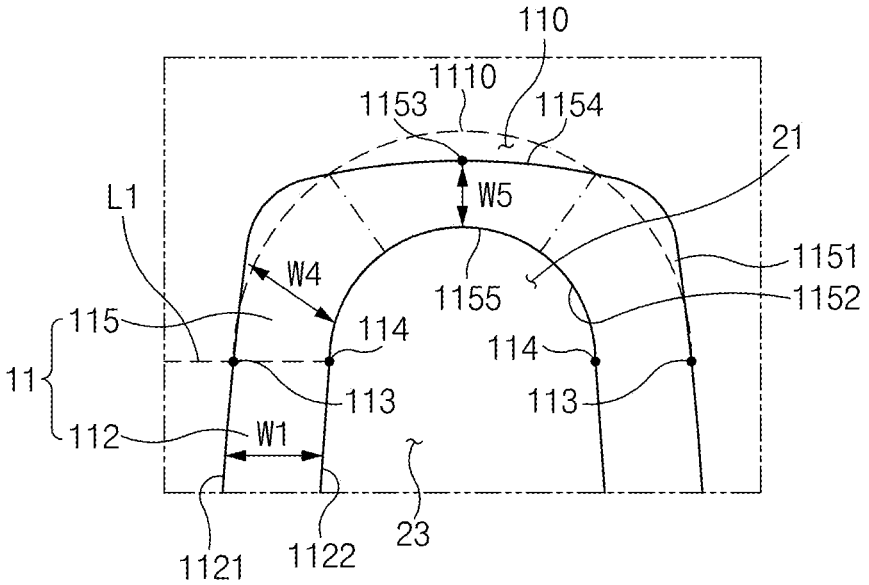
FIG. 3 is an enlarged front view illustrating a partial area of a heat transfer fin according to one modified example of the first embodiment of the present disclosure.

FIG. 3 is an enlarged front view illustrating a partial area of a heat transfer fin 1 according to one modified example of the first embodiment of the present disclosure.

In at least one distal surrounding part 115 according to the one modified example of the first embodiment of the present disclosure, one portion 1154 of an outer boundary 1151 that is located to correspond to the reference curve 1110 is located inward of the reference curve 1110. In the distal surrounding parts 111 and 115, at least parts of the outer boundaries 1111 and 1115 that are located to correspond to the reference curve 1110 are located inward of the reference curve 1110, by combining the first embodiment and the one modified example together.

As illustrated in FIG. 3, the shortest distance W5 between an inner boundary 1152 and the outer boundary 1151 that is obtained in an area of the distal surrounding part 115 that includes a point 1153 located at the farthest upstream side with reference to the second direction D2 is smaller than the shortest distances W1 and W4 between the inner boundary 1152 and the outer boundary 1151 that are obtained in other areas of the distal surrounding part 115. That is, the shortest distances W1 and W4 between the inner boundary 1152 and the outer boundary 1151 that are obtained at the farthest downstream side of the distal surrounding part 115 with respect to the second direction D2 are greater than the shortest distance W5 between the inner boundary 1152 and the outer boundary 1151 that is obtained in another area of the distal surrounding part 115.

As illustrated in FIG. 3, the one portion 1154 of the outer boundary 1151 of the distal surrounding part 115 may be located inward of the reference curve 1110, and the remainder may be located outward of the reference curve 1110. In this case, one portion of the distal surrounding part 115 defined between the outer boundary 1154 located inward of the reference curve 1110 and a reference inner boundary 1155 that is an inner boundary located to correspond to the outer boundary 1154 may be considered. The boundaries of the one portion are shown by dash-dot-dash lines in FIG. 3.

In an operating environment of the heat transfer fin 1, the one portion of the distal surrounding part 115 has a lower temperature than a virtual portion of the existing distal surrounding part 110 that is defined between the same reference inner boundary 1155 and a portion of the reference curve 1110 that is located to correspond to the reference inner boundary 1155. The portion of the reference curve 1110 that is located to correspond to the reference inner boundary 1155 is a virtual outer boundary when it is assumed that the outer boundary 1151 of the distal surrounding part 115 is formed along the reference curve 1110.

Another Modified Example

Figure 4:
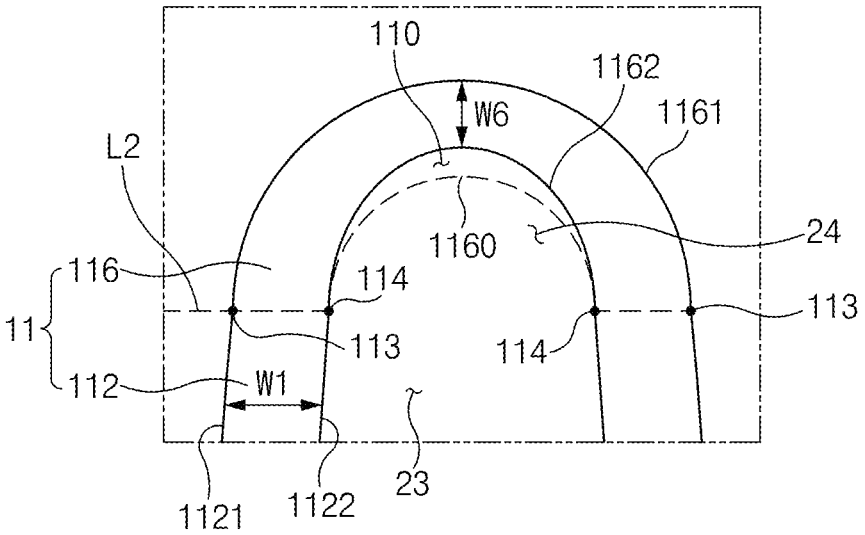
FIG. 4 is an enlarged front view illustrating a partial area of a heat transfer fin according to another modified example of the first embodiment of the present disclosure.

FIG. 4 is an enlarged front view illustrating a partial area of a heat transfer fin according to another modified example of the first embodiment of the present disclosure.

A distal surrounding part 116 according to the other modified example of the first embodiment of the present disclosure may be defined as an area formed between an inner boundary 1162 and an outer boundary 1161.

Referring to FIG. 4, a reference curve 1160 that is a virtual curve corresponding to the inner boundary of the distal surrounding part 110 of the existing heat transfer fin is shown by a dotted line. The reference curve 1160 has a curvilinear shape corresponding to the inner boundary 1162. The reference curve 1160 passes through specific points while maintaining a predetermined distance from the outer boundary 1161 on the same plane. When the reference curve 1160 maintains the predetermined distance from the outer boundary 1161, this means that the shortest distance from one point on the outer boundary 1161 to the reference curve 1160 remains constant for all points. The specific points are intersections where the inner boundary 1162 and a reference straight line L2 that is a virtual straight line drawn parallel to the first direction D1 cross each other. The same plane refers to a plane including the wide surface of the fin body 10 illustrated in FIG. 1. That is because the outer boundary 1161 is formed to have a curved profile on the plane including the wide surface of the fin body 10 that is parallel to the first direction D1 and the second direction D2.

The reference straight line L2 is drawn to cross the inner boundary 1162 of the distal surrounding part 116 at the inner contact points 114 where the distal surrounding part 116 and the middle surrounding parts 112 are connected. When the shortest distance from any point on the outer boundary 1161 to the reference curve 1160 is defined as the width of the existing distal surrounding part 110, the width of the entire existing distal surrounding part 110 remains constant. The width of the existing distal surrounding part 110 may be equal to the widths W1 of the middle surrounding parts 112.

In at least one distal surrounding part 116 according to the other modified example of the first embodiment of the present disclosure, the inner boundary 1162 located to correspond to the reference curve 1160 is located outward of the reference curve 1160. Here, when the inner boundary 1162 is located outward of the reference curve 1160, this means that the inner boundary 1162 is located upstream of the reference curve 1160 along the second direction D2.

The shortest distance W6 from an area located at the farthest upstream side of the distal surrounding part 116 with respect to the second direction D2 to a first distal area 24 of the through-hole 20 is smaller than the distance W1 between the inner contact point 114 and the outer contact point 113 where the distal surrounding part 116 meets the middle surrounding part 112 on one side. Accordingly, the width of the distal surrounding part 116 does not remain constant and decreases toward the upstream side.

The width of the distal surrounding part 116 may linearly decrease toward the upstream side with respect to the second direction D2. Here, the expression "linearly decreases" is used to mean that a variable quantity toward the upstream side with respect to the second direction D2 is linearly proportional to the reduction in the width of the distal surrounding part 116 that corresponds to the variable quantity toward the upstream side.

Outer Body Parts 30

Figure 5:
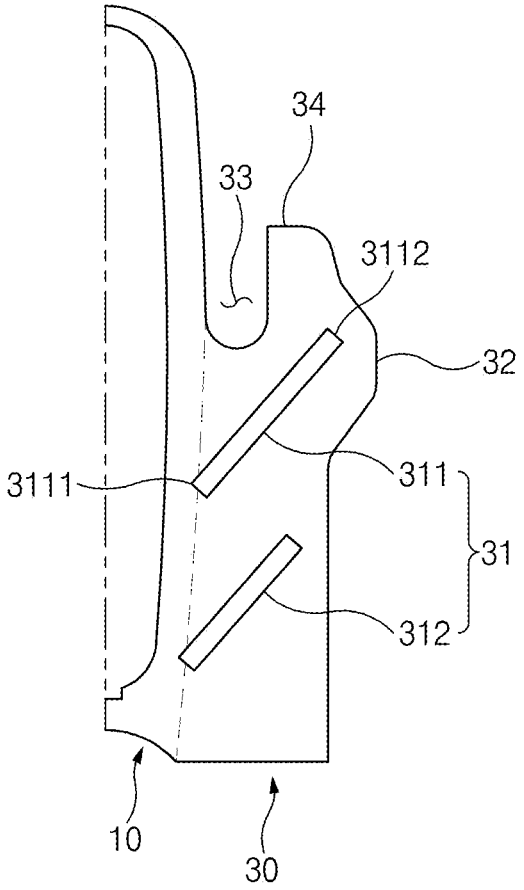
FIG. 5 is a blowup of an outer body part in FIG. 1.

FIG. 5 is an enlarged front view illustrating one of outer body parts 30 according to an embodiment of the present disclosure.

Referring to FIGS. 1 and 5, the outer body parts 30 may protrude outward from at least partial areas of opposite ends of the fin body 10 according to the embodiment of the present disclosure along the first direction D1. The two outer body parts 30 disposed on the opposite ends of the fin body 10 with respect to the first direction D1 may have line symmetry with respect to the center line parallel to the second direction D2.

In an embodiment of the present disclosure, the outer body parts 30 protrude from partial areas located downstream with respect to the second direction D2, among the areas of the opposite ends of the fin body 10 with respect to the first direction D1. However, the positions from which the outer body parts 30 protrude are not limited thereto.

A side louver 31 may be formed in each of the outer body parts 30. The side louver 31 refers to an opening that is formed through the outer body part 30 along a direction parallel to the reference direction and that extends in one direction inclined with respect to the second direction D2 on the plane perpendicular to the reference direction. As illustrated in FIGS. 1 and 5, the one direction may be a direction toward the fin body 10 along the second direction D2.

The side louver 31 may be formed by using a punching machine that presses a metal plate to make a through-hole in the metal plate. When the through-hole is formed by using the pressing member, the pressed material may protrude from the boundary of the through-hole in the pressing direction to form side burring (not illustrated). The side burring guides the combustion gas toward the tube inserted through the through-hole 20 adjacent to the side louver 31.

The outer body part 30 may include a plurality of side louvers 31. In an embodiment of the present disclosure, the outer body part 30 includes a first side louver 311 and a second side louver 312 spaced apart from the first side louver 311 with respect to the second direction D2. The plurality of side louvers 31 may have different lengths.

In an existing heat transfer fin (reference numeral 100 of FIG. 6), side louvers (reference numeral 310 of FIG. 8) are located in only the areas corresponding to the outer body parts 30. However, one end 3111 of each of the side louvers 31 that is adjacent to the through-hole 20 according to an embodiment of the present disclosure may be located in the fin body 10. In FIGS. 1 and 5, the fin body 10 and the outer body part 30 are divided from each other by a boundary shown by a dotted line, and the side louver 31 is across the corresponding boundary.

Furthermore, the first side louver 311 may extend toward a convex portion 32 that protrudes outward from the outer body part 30, and an opposite end 3112 of the first side louver 311 may be located in the convex portion 32. The convex portion 32 may protrude outward from a partial area adjacent to the upstream side of the outer body part 30.

The heat transfer fin 1 according to the first embodiment of the present disclosure has the side louvers 31 longer than the existing side louvers 310 as described above. Accordingly, the heat transfer fin 1 enables the combustion gas to intensively pass through the middle area 23 of the through-hole 20 rather than the end portion at the upstream side thereof and enables the heating medium flowing through the tube to be uniformly heated in various positions.

A fin side recess 33 may be formed along the second direction D2 in an upper end portion 34 of the outer body part 30 that is located at the upstream side of the outer body part 30 with respect to the second direction D2 and is horizontal along the first direction D1. A recess end portion located at the downstream side of the fin side recess 33 may have a semicircular profile on the plane perpendicular to the reference direction.

An end portion at the upstream side of the outer body part 30 and the fin body 10 may be spaced apart from each other because the fin side recess 33 is formed as illustrated in FIGS. 1 and 5. Accordingly, the heat that the combustion gas transfers to the outer body part 30 while passing the outer body part 30 cannot easily move to the distal surrounding part 111 via the middle surrounding parts 112 that surround the through-hole 20, and hence the concentration of heat on the first distal area 21 of the through-hole 20 may be prevented.

Hereinafter, the effects that the heat transfer fin 1 of the present disclosure has due to the configurations of the distal surrounding parts 111 according to the first embodiment and the modified examples thereof as compared with the existing heat transfer fin 100 will be described with reference to FIGS. 6 and 7.

Figure 6:
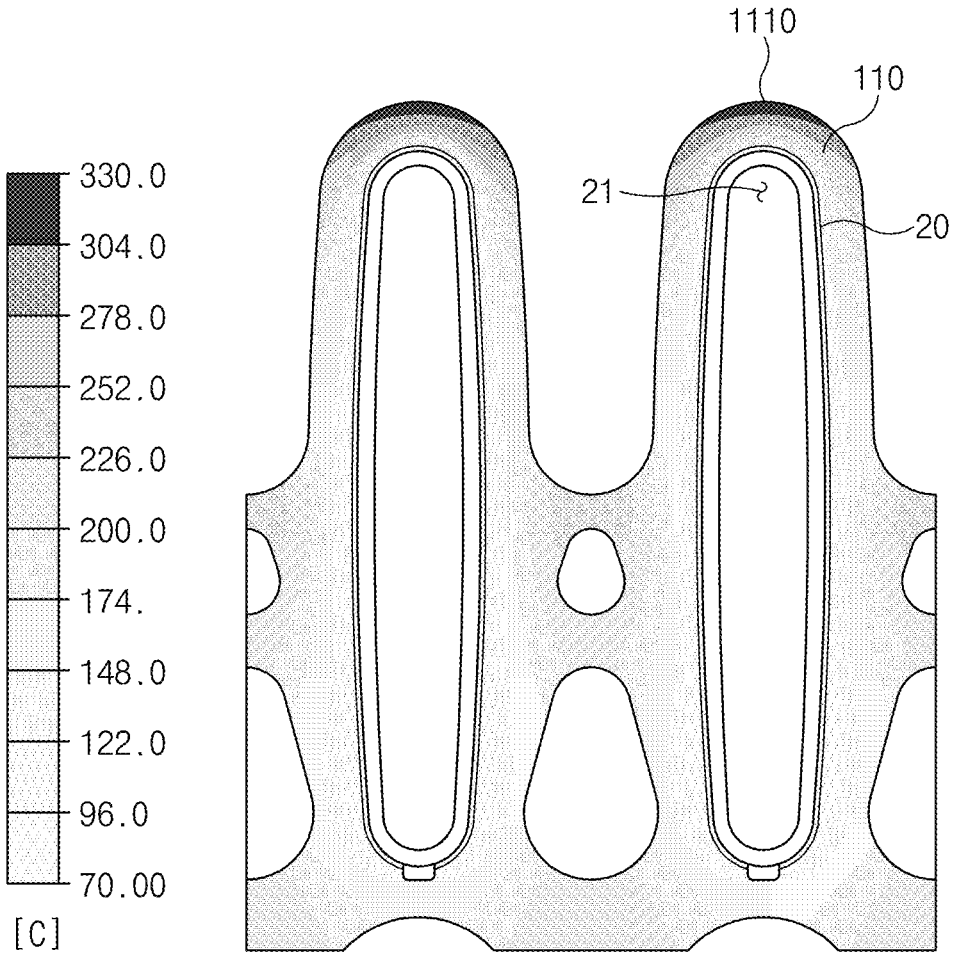
FIG. 6 is a view illustrating the temperature distribution of an existing heat transfer fin.

FIG. 6 is a view illustrating the temperature distribution of the existing heat transfer fin 100. FIG. 7 is a view illustrating the temperature distribution of the heat transfer fin 1 according to the first embodiment of the present disclosure into which the structure of the fin body 10 is introduced.

Referring to FIG. 6, the distal surrounding part 110 of the existing heat transfer fin 100 is formed along the reference curve 1110 illustrated in FIG. 2. Accordingly, it can be seen that a larger amount of heat is concentrated on the distal surrounding part 110 than on the other areas of the heat transfer fin 100 and hence the existing distal surrounding part 110 has a higher temperature than the other areas. Especially, it can be seen that, as illustrated in FIG. 6, the largest amount of heat is concentrated on the area of the existing distal surrounding part 110 that is located farthest from the tube.

Figure 7:
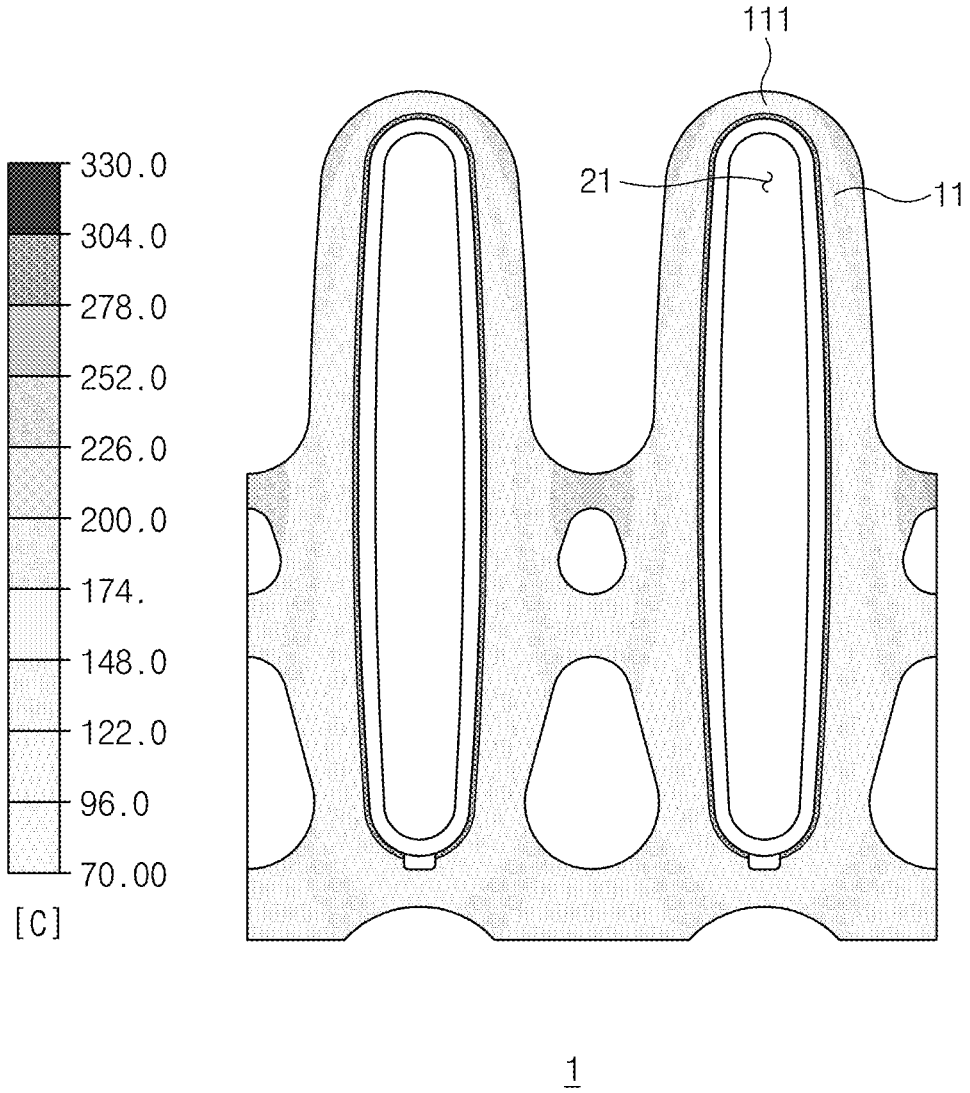
FIG. 7 is a view illustrating the temperature distribution of the heat transfer fin according to the first embodiment of the present disclosure into which a fin body structure is introduced.

Referring to FIG. 7, the distal surrounding part 111 according to an embodiment of the present disclosure is formed in the shape as illustrated in FIG. 7, and therefore the distal surrounding part 111 of the present disclosure has a smaller area than the distal surrounding part 110 in the existing heat transfer fin 100. Accordingly, it can be seen that the area located at the tip end of the distal surrounding part 111 according to the embodiment of the present disclosure is closer to the tube than the existing distal surrounding part 110 of FIG. 6 and therefore the distal surrounding part 111 has a lower temperature than the existing distal surrounding part 110.

Accordingly, the intensive heat transfer to the upstream side of the tube that is located in the first distal area 21 of the through-hole 20 is alleviated. As a result, the temperature in the tube may be relatively lowered, and hence the precipitation of lime, which is calcium oxide, may be reduced. In addition, the heat transfer fin 1 according to the first embodiment of the present disclosure has a structure in which the area of the distal surrounding part 111 is not simply reduced and the width of the distal surrounding part 111 is gradually decreased toward the first distal area 21 of the through-hole 20. Accordingly, the heat transfer fin 1 may prevent degradation in heating efficiency due to a rapid decrease in the amount of heat transferred.

Figure 9:
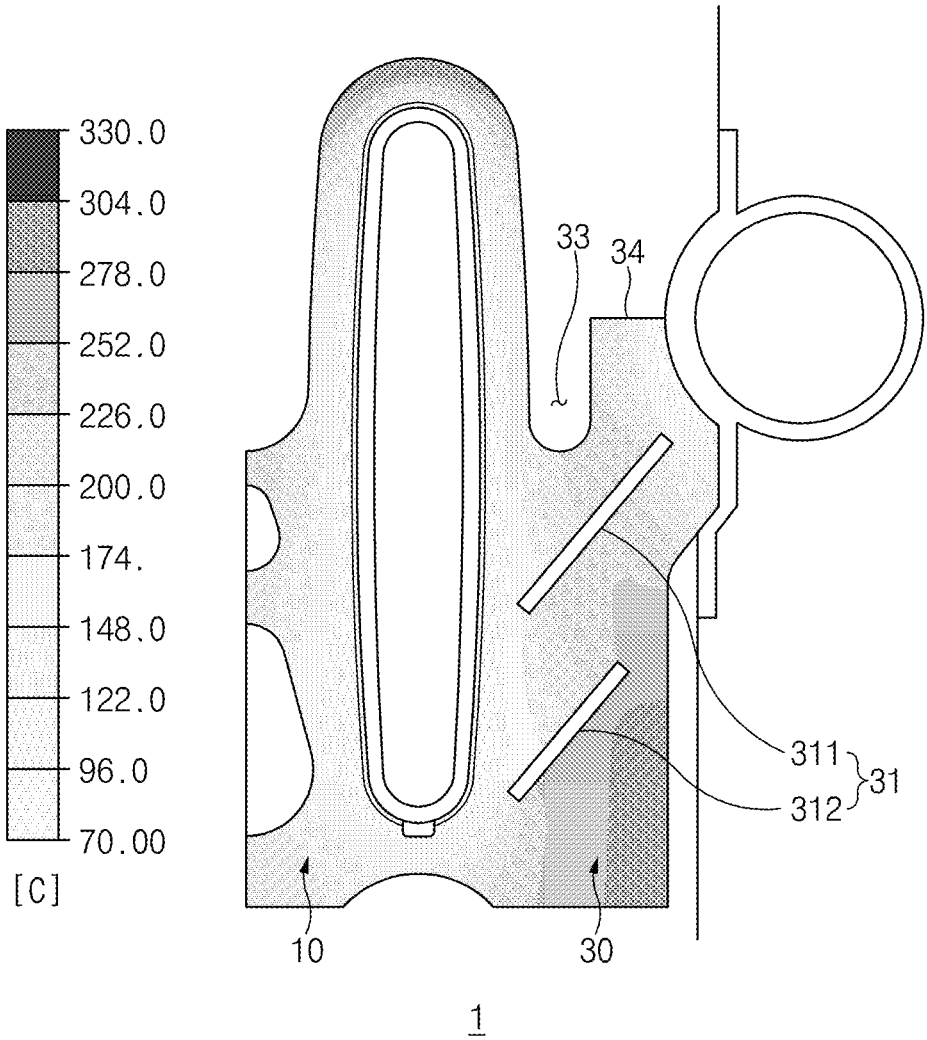
FIG. 9 is a view illustrating the temperature distribution of the heat transfer fin according to the first embodiment of the present disclosure into which the outer body part is introduced.

FIG. 8 is a view illustrating the temperature distribution of the existing heat transfer fin 100. FIG. 9 is a view illustrating the temperature distribution of the heat transfer fin 1 according to the first embodiment of the present disclosure into which the structure of the outer body part 30 is introduced.

Referring to FIG. 8, the existing side louvers 310 formed in the existing outer body part are shorter than the side louvers 31 of the heat transfer fin 1 according to the first embodiment of the present disclosure and therefore fail to reach the fin body. In addition, unlike in the first embodiment of the present disclosure, the fin body and the outer body part are connected without a fin side recess.

Referring to FIG. 9, the side louvers 31 according to the embodiment of the present disclosure that extend to the fin body 10 so as to be closer to the through-hole 20 are introduced, and therefore the passage between the side louvers 31 and the through-hole 20 is narrowed, which leads to a reduction in the flow rate of combustion gas that is a heating medium. Accordingly, the amount of heat transferred from the combustion gas to the tube is reduced, so that the tube remains at a relatively low temperature and the precipitation of lime is reduced.

In addition, due to the formation of the fin side recess 33 according to the embodiment of the present disclosure, the heat transfer area capable of transferring heat to the tube is deleted. Accordingly, the temperature of the tube may be lowered, and thus the precipitation of lime may be reduced.

Flanges 40

Referring again to FIG. 1, each of the intervening sections 14 may be formed in an area at the downstream side of the fin body 10, that is, in an area between the through-holes 20 adjacent to each other and downstream of the through-section 12, and the flange 40 may be additionally formed in the intervening section 14. The flange 40 may be formed in the intervening section 14 so as to be adjacent to the second distal area 22 of the through-hole 20. According to an embodiment of the present disclosure, the flange 40 includes a burring hole 412 and burring 411.

The burring hole 412 is an opening formed through the intervening section 14 of the fin body 10 along the reference direction by using a punching machine, similarly to the side louvers 31. The burring 411 protrudes in the reference direction along at least part of the periphery of the burring hole 412. Accordingly, the combustion gas blocked by the burring 411 of the flange 40 while flowing is directed toward the central area of the through-hole 20 that is adjacent to the flange 40, and enables the heating medium flowing through the tube to be more uniformly heated.

A plurality of flanges 40 may be disposed in one intervening section 14. As illustrated in FIG. 1, two flanges 41 and 42 may be formed in the intervening section 14. The flanges 41 and 42 may be spaced apart from each other along the second direction D2 and may be formed in a shape in which the width in the first direction D1 is gradually increased and then decreased toward the downstream side. Furthermore, the area of the burring hole 412 of the flange 42 located relatively downstream may be larger than the area of the burring hole 412 of the flange 41 located relatively upstream.

Second Embodiment

Figure 10:
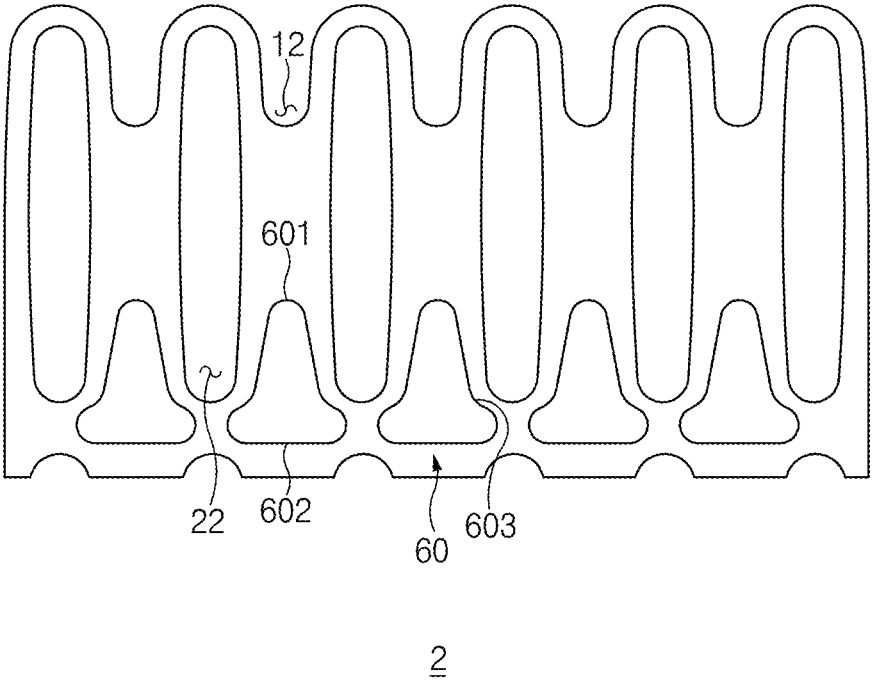
FIG. 10 is a front view illustrating a heat transfer fin according to a second embodiment of the present disclosure.

FIG. 10 is a front view illustrating a heat transfer fin 2 according to a second embodiment of the present disclosure.

In the heat transfer fin 2 according to the second embodiment of the present disclosure, a flange 60 may be formed such that the width in the first direction D1 is gradually increased toward the downstream side with respect to the second direction D2, and the degree to which the width of the flange 60 is increased may be varied with respect to a predetermined position 603. The predetermined position 603 may be located adjacent to the second distal area 22 of the through-hole 20 with respect to the second direction D2. Referring to FIG. 10, according to the second embodiment, an upstream-side end portion 601 of the flange 60 is sharp, and a downstream-side end portion 602 of the flange 60 is flat. The degree to which the width of the flange 60 in the first direction D1 is increased from the upstream-side end portion 601 of the flange 60 to the predetermined position 603 is less than the degree to which the width of the flange 60 in the first direction D1 is increased from the predetermined position 603 to the downstream-side end portion 602 of the flange 60. Accordingly, the degree to which the width is increased in the flange 60 is not uniform and is varied.

Third Embodiment

Figure 11:
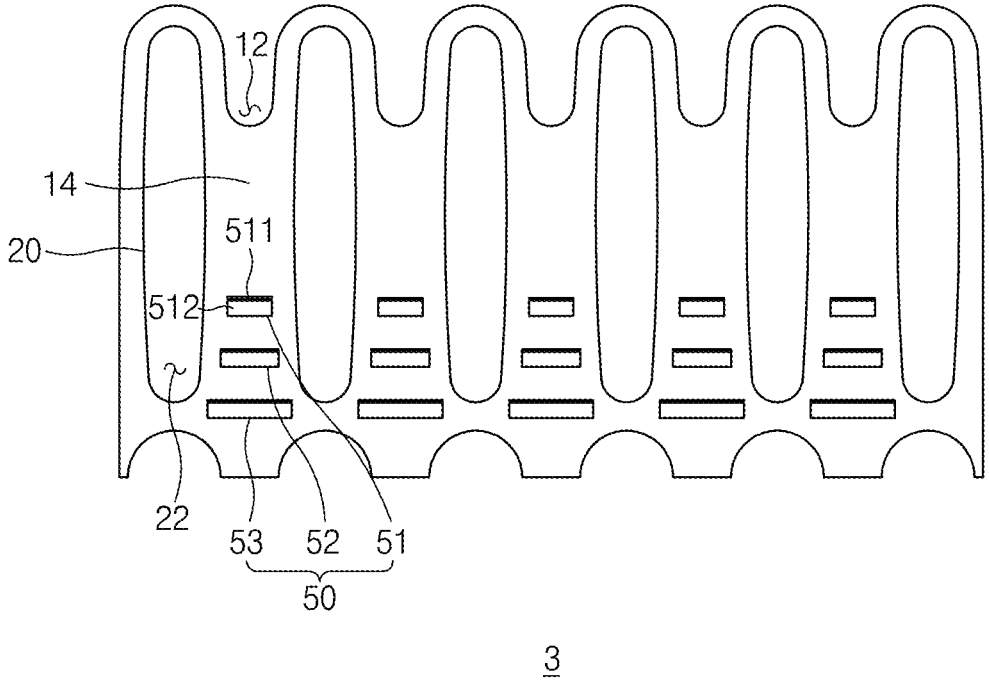
FIG. 11 is a front view illustrating a heat transfer fin according to a third embodiment of the present disclosure.

FIG. 11 is a front view illustrating a heat transfer fin 3 according to a third embodiment of the present disclosure.

When a flange 50 is formed as in the second embodiment and an upstream-side end portion of the flange 50 is formed adjacent to the through-section 12 to the maximum, heat may be uniformly and efficiently transferred to the heating medium. However, in the case where the upstream-side end portion of the flange 50 is located farther upstream in the process of punching the flange 50 in the fin body fixed to a chuck, the fin body is bent, and therefore there is difficulty in machining.

Referring to FIG. 11, in the heat transfer fin 3 according to the third embodiment of the present disclosure, the flange 50 may include a plurality of flanges 51, 52, and 53. The flanges 51, 52, and 53 may be spaced apart from each other along the second direction D2 and may extend along the first direction D1. Furthermore, in the first direction D1, the lengths of the flanges 52 and 53 located relatively downstream with respect to the second direction D2 are greater than the lengths of the flanges 51 and 52 located relatively upstream. Accordingly, similarly to the flange 40 or 60 of FIG. 1 or 10, the plurality of flanges 51, 52, and 53 may have a shape that gradually guides the combustion gas toward the through-hole 20.

In the flange 50 according to the third embodiment of the present disclosure, burring 511 may be disposed at the upstream side of a burring hole 512. That is because the combustion gas has to be guided toward an area adjacent to the through-hole 20 by a collision with the burring 511 before flowing through the burring hole 512.

Figure 12:
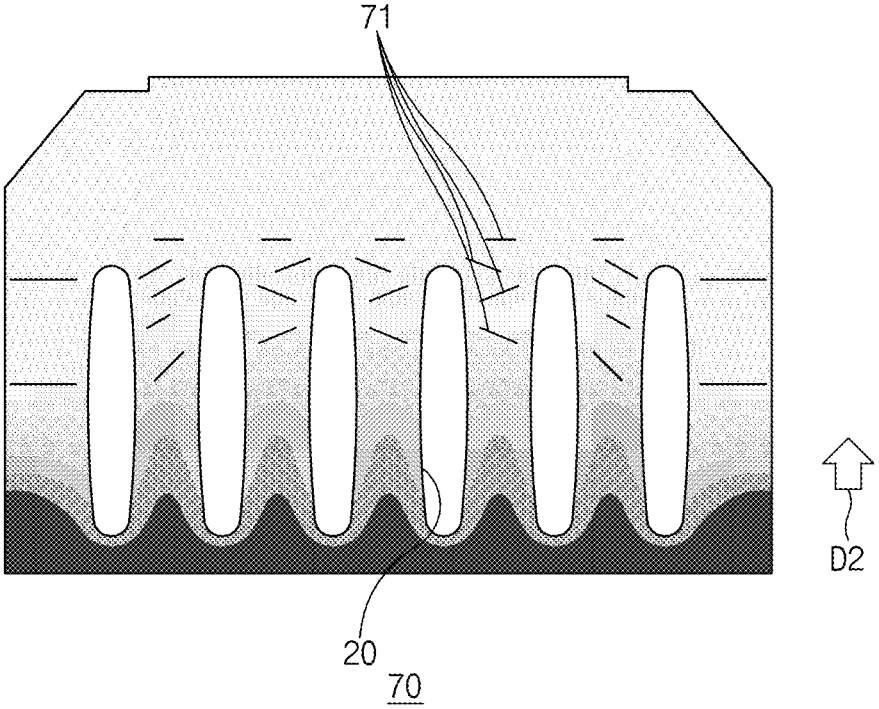
FIG. 12 is a view illustrating the temperature distribution of an existing heat transfer fin into which flanges are introduced.
Figure 13:
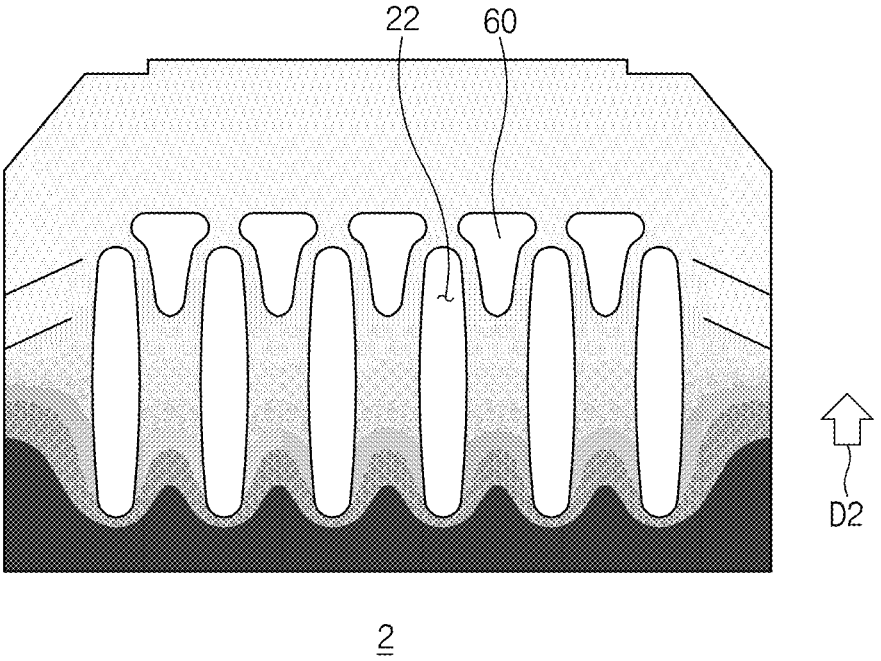
FIG. 13 is a view illustrating the temperature distribution of the heat transfer fin according to the second embodiment of the present disclosure.
Figure 14:
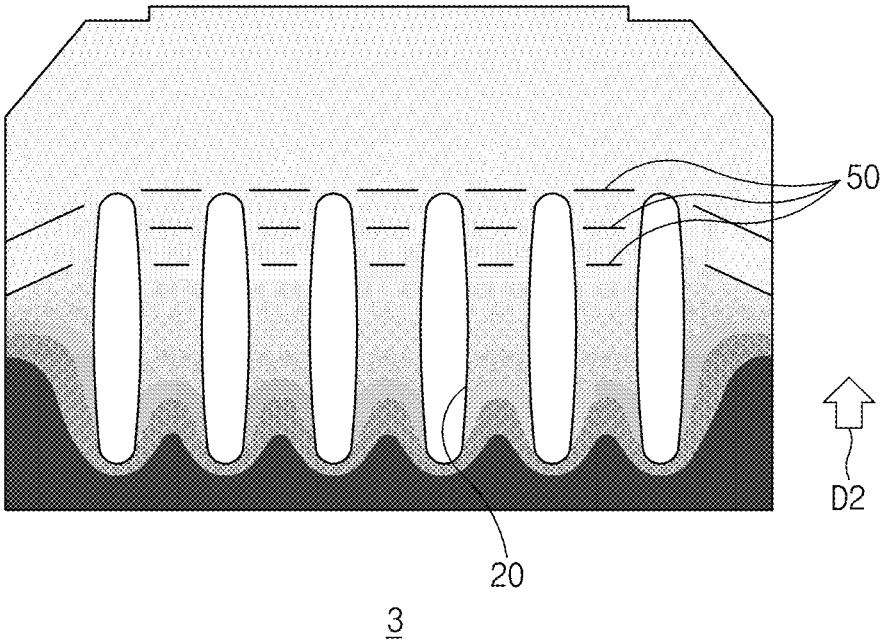
FIG. 14 is a view illustrating the temperature distribution of the heat transfer fin according to the third embodiment of the present disclosure.

FIG. 12 is a view illustrating the temperature distribution of an existing heat transfer fin 70 into which flanges 71 are introduced. FIG. 13 is a view illustrating the temperature distribution of the heat transfer fin 2 according to the second embodiment of the present disclosure. FIG. 14 is a view illustrating the temperature distribution of the heat transfer fin 3 according to the third embodiment of the present disclosure.

Referring to FIG. 12, the flanges 71 are arranged in zigzags in the existing heat transfer fin 70.

Referring to FIG. 13, it can be seen that the combustion gas is gradually guided toward the through-holes 20 without a sharp increase in resistance to a flow of the combustion gas in the case where the flanges 60 according to the second embodiment are introduced into the heat transfer fin 2. Furthermore, it can be seen that the degree to which the width of the flange 60 is increased increases in a position adjacent to the second distal area 22 of the through-hole 20 with respect to the second direction D2 and therefore the combustion gas is better guided into the second distal area 22 of the through-hole 20. Referring to FIG. 13, it can be seen that when the flanges 60 having this structure are applied, the temperatures of areas adjacent to the downstream sides of the through-holes 20 are relatively increased, as compared with when the exiting flanges 71 are applied.

As illustrated in FIG. 14, in the case where the flanges 50 according to the third embodiment, each of which includes the plurality of flanges 51, 52, and 53, are introduced into the heat transfer fin 3, each of the flanges 50 may be located in a position closer to the through-section 12 than the critical position where an upstream-side end portion of an integrated flange is located. Accordingly, it can be seen that the flanges 50 more easily guide the combustion gas into the middle areas of the through-holes 20 and when the flanges 50 are applied, the temperatures of areas adjacent to the downstream sides of the through-holes 20 are relatively increased, as compared with when the exiting flanges 71 are applied.

According to the embodiments of the present disclosure, the temperature distribution characteristics of the heat transfer fins are improved, and lime generated in tubes combined with the heat transfer fins is reduced.

Hereinabove, even though all of the components are coupled into one body or operate in a combined state in the description of the above-mentioned embodiments of the present disclosure, the present disclosure is not limited to these embodiments. That is, all of the components may operate in one or more selective combination within the range of the purpose of the present disclosure. Further, it should be also understood that the terms of "include", "comprise" or "have" in the specification are "open type" expressions just to say that the corresponding components exist and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

The invention claimed is:

1. A heat transfer fin comprising:

a fin body having a plate shape with a planar shape; and a plurality of through-holes formed through the fin body and spaced apart from each other in a first direction along the planar surface of the fin body, wherein, when the flow direction of combustion gas that is to flow along the planar a surface of the fin body is referred to as a second direction, the fin body includes a distal surrounding part configured to surround a first distal area located at the farthest upstream side of each of the through-holes with respect to the second direction and middle surrounding parts extending from the distal surrounding part, wherein the shortest distance between an inner boundary and an outer boundary of the distal surrounding part that is obtained in an area of the distal surrounding part that is located at the farthest upstream side with respect to the second direction is smaller than the shortest distance between the inner boundary and the outer boundary that is obtained in an area of the distal surrounding part that is located at the farthest downstream side with respect to the second direction, and wherein the shortest distance between the inner boundaries and the outer boundaries of the middle surrounding parts is bigger than or equal to the farthest distance between the inner boundary and the outer boundary of the distal surrounding part.

2. The heat transfer fin of claim 1, wherein the inner boundary of the distal surrounding part is a boundary by which the distal surrounding part and the first distal area are divided from each other, and wherein the outer boundary of the distal surrounding part is a boundary by which the distal surrounding part and the outside of the fin body are divided from each other.

3. The heat transfer fin of claim 1, wherein the shortest distance between the inner boundary and the outer boundary that is obtained in the area of the distal surrounding part that is located at the farthest upstream side with respect to the second direction is smaller than the shortest distance between the inner boundary and the outer boundary that is obtained in another area of the distal surrounding part.

4. The heat transfer fin of claim 1, wherein a through-section formed through the fin body so as to be open in a direction opposite to the second direction from the inside of the fin body is provided between two distal surrounding parts configured to surround first distal areas of two through-holes arranged adjacent to each other along the first direction.

5. The heat transfer fin of claim 1, wherein the middle surrounding parts extending from the distal surrounding part in the second direction and are, configured to surround at least opposite sides of a middle area of the through-hole that is located downstream of the first distal area with respect to the second direction, wherein the opposite sides of the middle area are oriented in the first direction.

6. The heat transfer fin of claim 5, wherein the outer boundary of the distal surrounding part and the outer boundaries of the middle surrounding parts connected thereto are represented by differently defined curves, at at least connection points where the outer boundary of the distal surrounding part is connected with the outer boundaries of the middle surrounding parts.

7. The heat transfer fin of claim 5, wherein the shortest distance from any point on the inner boundary of the distal surrounding part to the outer boundary of the distal surrounding part gradually decreases toward a direction opposite to the second direction along the inner boundary of the distal surrounding part.

8. The heat transfer fin of claim 1, further comprising:

two outer body parts protruding outward from at least partial areas of opposite ends of the fin body with respect to the first direction.

9. The heat transfer fin of claim 8, wherein a side louver is formed through each of the outer body parts and extends in one direction inclined with respect to the second direction, and wherein one end of the side louver that is adjacent to the through-hole is located in the fin body.

10. The heat transfer fin of claim 9, wherein the side louver includes a first side louver and a second side louver spaced apart from the first side louver along the second direction, and wherein the first side louver is longer than the second side louver.

11. The heat transfer fin of claim 10, further comprising:

a convex portion protruding outward from the outer body part, wherein the first side louver extends toward the convex portion and an opposite end of the first side louver is located in the convex portion.

12. The heat transfer fin of claim 8, wherein a fin side recess is formed along the second direction in an upper end portion of each of the outer body parts that is located at an upstream side of the outer body part with respect to the second direction.

13. The heat transfer fin of claim 12, wherein a recess end portion located at a downstream side of the fin side recess with respect to the second direction has a semicircular profile on the fin body.

14. The heat transfer fin of claim 1, further comprising:

a flange including a burring hole and burring, wherein the burring hole is formed through an intervening area of the fin body that is located between the through-holes adjacent to each other and at a downstream side of the fin body, and the burring protrudes from the fin body along at least part of a periphery of the burring hole.

15. The heat transfer fin of claim 14, wherein the flange includes a plurality of flanges that are spaced apart from each other along the second direction and that extend along the first direction.

16. The heat transfer fin of claim 15, wherein among the plurality of flanges, a flange located relatively downstream with respect to the second direction is longer than a flange located relatively upstream.

17. The heat transfer fin of claim 15, wherein the burring is disposed at an upstream side of the burring hole with respect to the second direction.

18. The heat transfer fin of claim 14, wherein the flange includes a plurality of flanges that are spaced apart from each other along the second direction and that have a shape in which a width in the first direction is gradually increased and then decreased toward a downstream side with respect to the second direction, and wherein a burring hole of a flange located relatively downstream among the plurality of flanges has a larger area than a burring hole of a flange located relatively upstream.

19. The heat transfer fin of claim 14, wherein a width of the flange in the first direction is increased toward a downstream side with respect to the second direction, and wherein a degree to which the width of the flange in the first direction is increased from an upstream-side end portion of the flange to a predetermined position along the second direction is less than a degree to which the width of the flange in the first direction is increased from the predetermined position to a downstream-side end portion of the flange.

* * * * *